US011426667B1

(12) United States Patent
Lindberg et al.

(10) Patent No.: US 11,426,667 B1
(45) Date of Patent: Aug. 30, 2022

(54) TOY FIGURINE WITH PLUSH COVERING

(71) Applicant: Mattel, Inc., El Segundo, CA (US)

(72) Inventors: Kelley Lindberg, Los Angeles, CA (US); Isaac Luk, Torrance, CA (US); Kenna O'Brien, Redondo Beach, CA (US)

(73) Assignee: MATTEL, INC., El Segundo, CA (US)

( * ) Notice: Subject to any disclaimer, the term of this patent is extended or adjusted under 35 U.S.C. 154(b) by 0 days.

(21) Appl. No.: 17/507,455

(22) Filed: Oct. 21, 2021

(51) Int. Cl.
*A63H 3/52* (2022.01)
*A63H 3/44* (2006.01)

(52) U.S. Cl.
CPC ..... *A63H 3/52* (2013.01); *A63H 3/44* (2013.01)

(58) Field of Classification Search
CPC ... A63H 3/08; A63H 3/44; A63H 3/52; A63H 3/365
USPC ... 446/98, 99, 100, 321, 369, 371, 372, 376, 446/385, 387, 388
See application file for complete search history.

(56) References Cited

U.S. PATENT DOCUMENTS 2,093,207 A * 9/1937 Munson, Jr. ..... A63H 3/52 446/98
3,783,554 A * 1/1974 Shapero ..... A63H 3/52 446/87
3,811,220 A * 5/1974 Glass ..... A63H 3/12 446/321
4,414,774 A * 11/1983 Fogarty ..... A63H 3/52 446/98
4,639,233 A * 1/1987 Brassfield ..... A63H 3/12 446/321
4,734,075 A * 3/1988 Park ..... A63H 3/12 446/321
5,006,089 A * 4/1991 Lee ..... A63H 3/02 428/100
5,127,107 A * 7/1992 Wood ..... A63H 3/12 2/173
5,328,400 A * 7/1994 Bass ..... A63H 3/50 428/100
5,588,895 A * 12/1996 Larson ..... A63H 3/00 428/13
6,164,972 A * 12/2000 Winslow ..... G09B 19/00 434/219
6,227,930 B1 * 5/2001 Norman ..... A63H 3/52 2/243.1
6,475,054 B1 * 11/2002 Liu ..... A63H 3/10 446/387
6,755,712 B2 * 6/2004 Morris ..... A63H 3/005 446/268
7,384,325 B2 * 6/2008 Kelly ..... A63H 13/00 446/268
7,448,932 B2 * 11/2008 Buckley ..... A63H 3/52 446/135
8,393,932 B1 * 3/2013 Norman ..... A63H 3/36 446/97
10,421,025 B1 * 9/2019 Ward ..... A63H 3/46
(Continued)

*Primary Examiner* — Joseph B Baldori
(74) *Attorney, Agent, or Firm* — Edell, Shapiro & Finnan, LLC

(57) ABSTRACT

A toy figurine comprising a figurine body with an identity selected from a set of identities and a removable plush costume covering the figurine body and obscuring the identity of the figurine body. The plush costume includes one or more separately removable portions and removing one or more of the separately removable portions reveals the identity of the figurine body.

19 Claims, 3 Drawing Sheets

(56) References Cited

U.S. PATENT DOCUMENTS

| | | | | |
|---|---|---|---|---|
| 2007/0155280 | A1* | 7/2007 | Patean | A63H 3/44<br>446/385 |
| 2012/0329362 | A1* | 12/2012 | Rudin | A63H 3/52<br>446/369 |
| 2019/0038982 | A1* | 2/2019 | Clark | A63H 3/44 |
| 2021/0228994 | A1* | 7/2021 | O'Brien | A63H 3/50 |

* cited by examiner

TOY FIGURINE WITH PLUSH COVERING

FIELD OF THE INVENTION

The present invention relates generally to toy dolls and figurines, and in particular, toy dolls and figurines with an outer covering that can be removed to reveal the identity of the toy doll or figurine.

BACKGROUND OF THE INVENTION

Toy dolls and figurines (for simplicity, referred to herein as toy figurines) have long been a source of entertainment for children of all ages. Through the years, various interactive features and accessories have been incorporated into or included with toy figurines to provide additional play value. For example, some toy figurines have mechanical features (e.g., closing eyelids, bottle feeding mechanisms) and/or electronic features (e.g., lights, sounds). Other toy figurines include hair play features and/or fashion accessories (e.g., clothing, handbags, jewelry) that can be used to change or customize the appearance of the toy figurine. But while there are many different toy figurines in the art, there is still a need for ever more interesting and varied toy figurines with features and accessories that can surprise and entertain a child.

SUMMARY OF THE INVENTION

A toy figurine set is provided herein that includes a toy figurine with a plush covering that hides or obscures the identity of the toy figurine. More specifically, the plush covering conceals identifying characteristics of the underlying figurine body, such as the skin complexion, facial feature, hair style, and/or body shape of the figurine body. When at least a portion of the plush covering is removed (such as a portion covering the head), the toy figurine's identity (as defined by its skin complexion, facial feature, and/or hair style) is revealed. Additionally, the toy figurine set includes accessories that may be worn or attached to the toy figurine. The accessories are preferably packaged in obscure packaging so that a completed look of the toy figurine is revealed when the accessories are removed from the packaging and applied to the toy figurine. Thus, the toy figurine set provides multiple surprise reveals that add to the play value of the toy.

In one or more embodiments, the toy figurine comprises a figurine body and a removable plush costume that covers the figurine body and obscures the identity of the figurine body. Typically, the identity of the figurine body is selected from a set of identities, which may be defined by at least one of a skin complexion, facial feature, hair style, and body shape. The plush costume includes one or more separately removable portions, such as a head portion, an upper torso portion, a lower torso portion, a hand portion, and/or a feet portion. Removing one or more of these separately removable portions reveals the identity of the figurine body. In one instance, the plush costume is an animal costume with a head portion resembling the head of an animal.

The toy figurine may include one or more accessories configured to be worn or attached to the figurine body, such as a hair accessory, clothing article, and/or shoes. In certain embodiments, the one or more accessories are packaged in obscure packaging that conceals the accessories so that a completed look of the toy figurine is revealed when the accessories are removed from the obscure packaging and worn or attached to the figurine body. Furthermore, the figurine body may include one or more thermochromic features, for example a thermochromic facial feature or a thermochromic hair.

Other objects, features and advantages of the present invention will become apparent to those skilled in the art from the following detailed description. It is to be understood, however, that the detailed description and specific examples, while indicating some embodiments of the invention, are given by way of illustration and not limitation. Many changes and modifications within the scope of the invention may be made without departing from the spirit thereof, and the present invention includes all such modifications.

BRIEF DESCRIPTION OF THE DRAWINGS

Referring now to the drawings in which like reference numbers represent corresponding parts throughout:

FIG. 1A illustrates the toy figurine with a figurine body that is concealed by a plush costume. FIG. 1B illustrates the toy figurine with the head portion of the plush costume removed;

DETAILED DESCRIPTION OF THE INVENTION

Figure 1B:
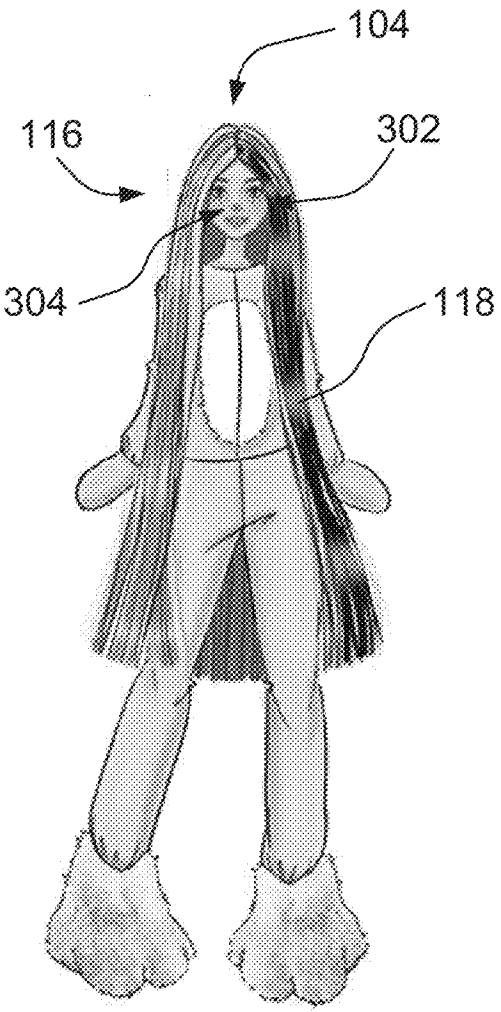
FIGS. 1A-1B illustrate a toy figurine, in accordance with an embodiment of the invention.
Figure 1A:
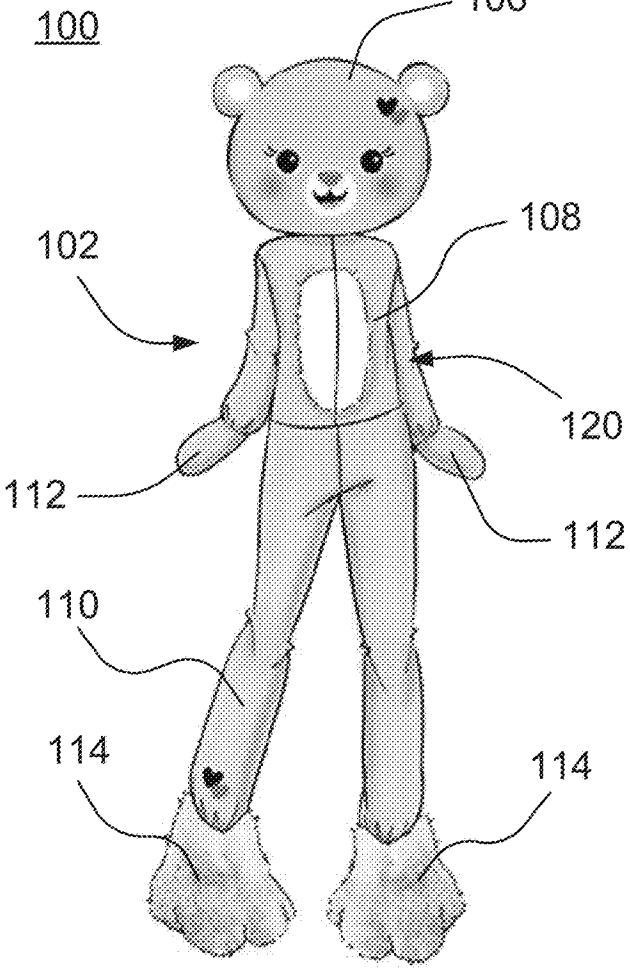

A toy figurine with surprise reveal elements associated with the discovery of the identity and completed look of the toy figurine is disclosed. FIGS. 1A-4 provide an illustrative embodiment of the toy figurine with its removable plush covering or costume and accessories. As shown in FIG. 1A, toy figurine 100 is initially presented wearing a plush costume 102 that resembles a pink bear. The plush costume can be of any style or shape, though in some implementations, the plush costume is fabricated to resemble or be a fanciful depiction of an animal or character. Plush costume 102 is wholly or substantially made of a soft outer fabric and may include a compressible stuffing material underneath the soft outer fabric. Furthermore, plush costume 102 is made of separately removable sections, which includes a head portion 106, an upper torso portion 108, a lower body or a lower torso portion 110, hand portions 112, and feet portions 114. In the illustrative embodiment depicted in FIG. 1A, the head portion 106, upper torso portion 108, and lower torso portion 110 are made of soft outer fabric or plush material, while hand portions 112 and feet portions 114 are made of a hard plastic or stretchable rubber material. In another embodiment, the whole plush costume is made of soft outer fabric or plush material.

Collectively, the different sections or portions of plush costume 102 cover a figurine body 104 and conceal or obscure the identity of figurine body 104. More specifically, plush costume 102 substantially hides one or more identifying traits or characteristics of figurine body 104, for example the skin complexion, facial features, hair style, and/or body shape of figurine body 104. To be clear, the term "conceal" does not require that the overall shape of the figurine body be hidden. For instance, the arms operatively (e.g., movably) coupled to the torso, legs operatively (e.g., movably) coupled to the torso, and general outline of figurine body 104 are discernable from the shape of plush costume 102 (see FIG. 1A). However, the identifying traits or characteristics of figurine body 104 (e.g., skin complexion, facial features, hair style, body shape) are hidden. Thus, when toy figurine 100 is initially presented wearing plush costume 102, the identity of the underlying figurine body 104 is a mystery. A child would be unable to tell which character (for example from a collection of different toy figurine characters or identities) she has in her possession until the plush costume is removed. Furthermore, even after the identity of the toy figurine has been revealed, the child can put the plush costume back on the figurine body and continue to enjoy and play with the toy figurine in its costumed appearance. The shape of plush costume 102 allows the head, arms, legs, and/or torso of the costumed toy figurine 100 to be moved and repositioned into different poses.

In some embodiments, certain portions of the figurine body are not covered by the plush costume and are exposed, yet the plush costume is still able to conceal the identity of the toy figurine. For example, the plush costume may not have hand portions or foot portions (i.e., the hands and/or feet of the toy figurine are exposed). However, because one or more identifying characteristics or traits of the toy figurine are hidden (e.g., facial features, hair style, body shape), a child would still be unable to determine the specific identity of the toy figurine. In yet other embodiments, the plush costume conceals all the identifying traits of the toy figurine, including the general shape or structure of the figurine body. The plush costume may have a shape that is completely different than the general shape of the underlying figurine body (e.g., rectangle). The arms, legs, and general outline of the underlying figurine body would not be discernable from the shape of the plush costume for an even greater mystery and surprise reveal.

When plush costume 102 or certain portions of plush costume 102 are removed from figurine body 104, the identity or certain identifying traits of figurine body 104 are uncovered. For instance, FIG. 1B shows toy figurine 100 with head portion 106 removed. This exposes a head 116 (mounted or operatively coupled to the torso) revealing the skin complexion, facial features, and hair style of figurine body 104. Based on one or more of these identifying characteristics, a child would be able to determine which character she has in her possession. However, depending on the identities of the characters available, removing just the head portion may be insufficient to determine the specific identity of the toy figurine. For example, there may be multiple characters with the same skin complexion, facial features, and hair style but different body shapes. Thus, the exact identity of the toy figurine would only be revealed when upper torso portion 108 is also removed. Other embodiments may include other identifying traits (e.g., fingernail color, decorations, patterns) that are revealed only when other portions of the plush costume (e.g., hand portions, feet portions) are removed. In yet further embodiments, the plush costume itself may provide a hint or indicator as to the identity of the toy figurine. Different plush costumes may each be associated with a specific character and figurine body (see, e.g., FIG. 5).

Head portion 106 is fabricated to resemble the head of a bear and is further sized to contain all the hair 118 attached to head 116 of figurine body 104. When head portion 106 is initially removed from toy figurine 100, the long hair 118 is fully revealed for an exciting effect. The opening of head portion 106 includes a stretchy fabric or elastic band that helps keep head portion 106 attached to head 116 and retain hair 118 within head portion 106. In alternative embodiments, the hair may be of any length and the head portion of the plush costume may be of any form or size suitable to conceal the head and hair of the figurine body.

Different accessories may be included with the toy figurine as part of a toy figurine set. In the illustrative embodiment shown in FIG. 2, accessories 200 include a headband 202, a comb 204, a pair of shoes 206, a pet bear 208, and a skirt 210. The headband 202, pair of shoes 206, and skirt 210 may be worn or attached to figurine body 104, while the comb 204 and pet bear 208 may be used to play or interact with toy figurine 100. In alternative embodiments, other accessories (of any type, style, shape, color, etc.) that can be used to play or interact with the toy figurine may be included as part of the toy figurine set.

Accessories 200 are individually packaged in obscure packaging so that the accessories included in the toy figurine set are initially concealed and a mystery to a child. Specifically, headband 202 is initially contained within packaging 201, comb 204 is initially contained within packaging 203, shoes 206 are initially contained within packaging 205, pet bear 208 is initially contained within packaging 207, and skirt 210 is initially contained within packaging 209. The individually packaged accessories 200 provide multiple additional elements of surprise as the child opens the packaging to reveal each accessory. Moreover, multiple accessories (i.e., headband 202, shoes 206, and skirt 210) contribute to the appearance of the toy figurine so that a completed look 300 of toy figurine 100 is ultimately revealed when the wearable accessories 202, 206, 210 are all removed from their packaging and attached to figurine body 104 (see FIG. 3).

Typically, packaged accessories 200 are stored within a container or packaging containing the toy figurine set. In other embodiments, one or more of the packaged accessories 200 may be initially stored within plush costume 102 of toy figurine 100. For instance, one or more accessories may be contained within upper torso portion 108. The accessories become accessible when upper torso portion 108 is opened and/or removed from figurine body 104. In other instances, different packaged accessories may be stored in different areas within the plush costume (for example within head portion 106 or lower torso portion 110). In some implementations, the accessories 200 are collectively stored and concealed within a package that visually obscures the accessories 200.

Figure 3:
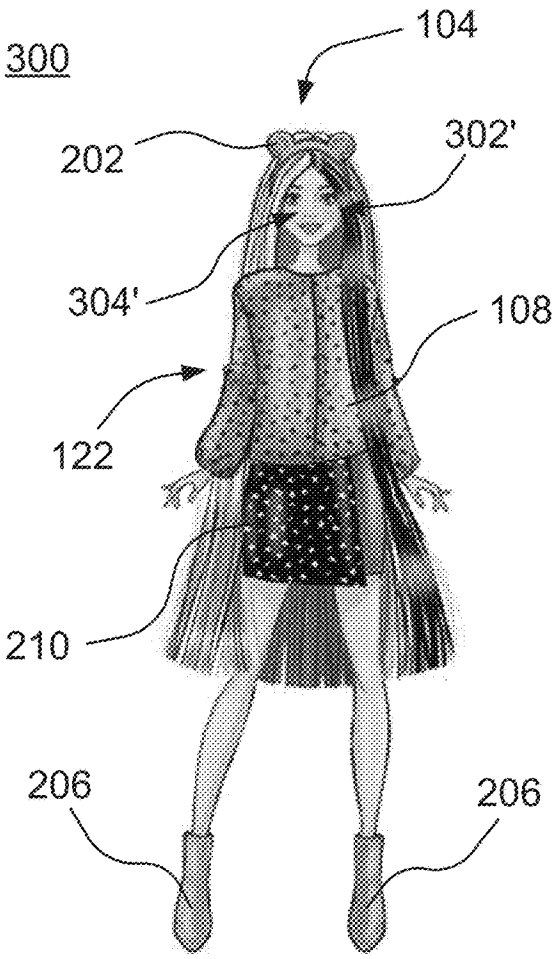
FIG. 3 illustrates a completed look of the toy figurine of FIGS. 1A-1B with the wearable accessories of FIG. 2 attached, in accordance with an embodiment of the invention.
Figure 2:
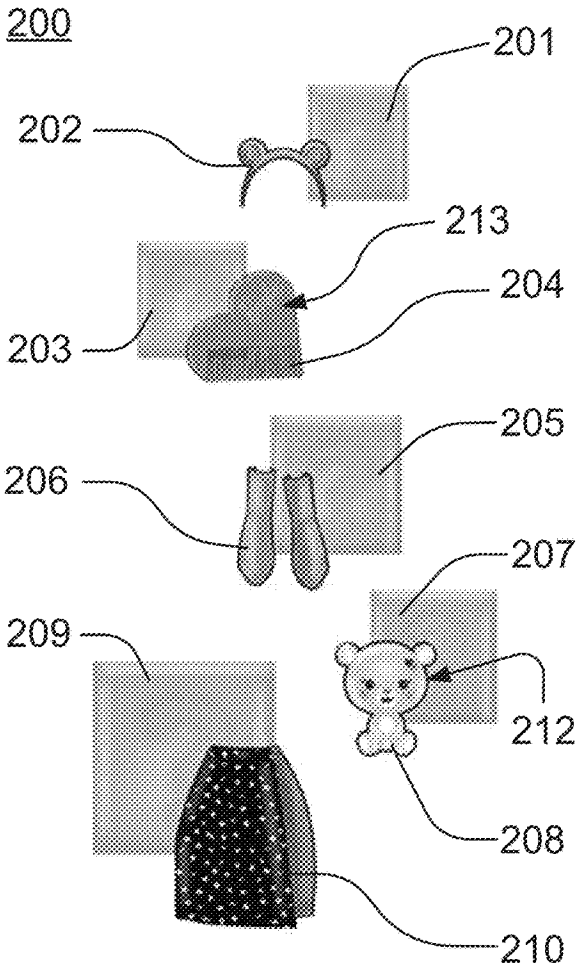
FIG. 2 illustrates various accessories that are included with the toy figurine of FIGS. 1A-1B as part of a toy figurine set, in accordance with an embodiment of the invention.
Figure 4:
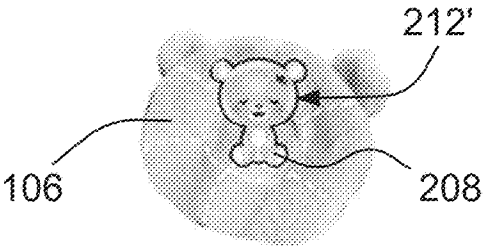
FIG. 4 illustrates the head portion of the plush costume of FIG. 1A being used as a bed for one of the accessories of FIG. 2, in accordance with an embodiment of the invention.

Furthermore, upper torso portion 108 is reconfigurable to provide different looks when worn on figurine body 104. More specifically, upper torso portion 108 may be flipped inside-out such that a different portion of the clothing article is visible and exposed. As shown in FIG. 1A, upper torso portion 108 is worn in a first configuration 120 where a first surface of the outwardly facing side is a pink plush material that matches the rest of plush costume 102. As shown in FIG. 3, upper torso portion 108 can be flipped inside-out into a second configuration 122 where a second surface (previously oriented as the inner side of upper torso portion 108) is now oriented outwardly. In the second configuration 122, upper torso portion 108 becomes a jacket that complements the other accessories attached to figurine body 104 and forms part of the completed look 300 of the toy figurine. In some embodiments, other sections of the plush costume may also be reconfigurable in a manner similar to upper torso portion 108. For example, lower torso portion 110 may also be reversible so that it becomes a pair of sweatpants when it is flipped inside-out. In yet another embodiment, each portion 106, 108, 110, 112, 114 of the plush costume 102 is reversible such that each portion 106, 108, 110, 112, 114 has a first surface having a first design (e.g., pattern, material, and/or print), and a second surface, opposite the first surface, having a second design different from the first design.

Toy figurine 100 has various thermochromic features, for example thermochromic makeup on cheeks 302 and nose 304. The thermochromic facial features change color in response to temperature variations (e.g., hot/warm or ice/cold water), as is disclosed in U.S. Pat. No. 5,503,583, which is issued to Hippely et al. and entitled TOY WITH THERMOCHROMIC MATERIAL, the entirety of which is hereby incorporated by reference. In the exemplary embodiment shown in FIG. 1B, decorative makeup is visible on cheeks 302. When warm water is applied to cheeks 302, the color of the thermochromic material contained in the decorative makeup lightens, giving the illusion that the decorative makeup has been removed (see cheeks 302' in FIG. 3). Applying cold water to cheeks 302' causes the color of the thermochromic material contained in the decorative makeup to darken and reappear, so a child can pretend to be reapplying makeup to the toy figurine's cheeks. Similarly, when warm water is applied to nose 304 (see FIG. 1), the red thermochromic paint on the figurine's nose lightens and "disappears" as shown on nose 304' (see FIG. 3). Applying cold water to nose 304' causes the red thermochromic paint to darken and become visible again on nose 304.

Other areas of figurine body 104 may also have thermochromic features or be made of a thermochromic material. In one embodiment, the toy figurine includes thermochromic hair. When cold water is applied to the hair, certain strands of hair turn into a different color or shade (for example from pink highlights into purple highlights). In another example, an undergarment (e.g., a onesie, unitard, shirt, tank top) may be painted onto the figurine body using thermochromic paint. Applying warm or cold water changes the color or pattern of the undergarment. Additionally, one or more of the accessories or portions of the plush costume may have a thermochromic feature. For instance, the eyes of pet bear 208 change between an open/awake look 212 or a closed/sleeping look 212' when cold or warm water is applied, respectively (see FIGS. 2 and 4). Furthermore, comb 204 not only can be used to brush the hair of the toy figurine, but also includes a sponge portion 213 that can be used to apply water of different temperatures to the toy figurine and pet bear 208. Removed sections of plush costume 102 may also have additional play features. In the exemplary implementation shown in FIG. 4, removed head portion 106 transforms into a bed for pet bear 208.

Figure 5:
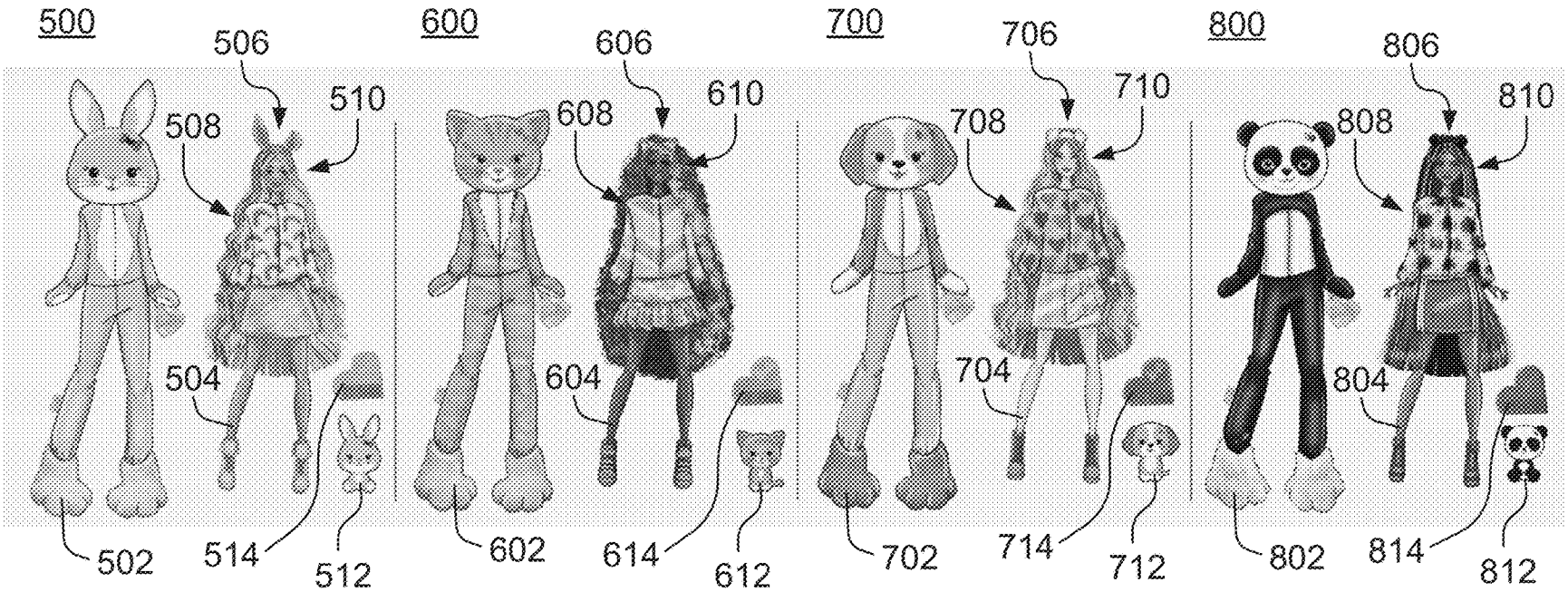
FIG. 5 illustrates four examples of alternative toy figurine identities and their respective completed looks, in accordance with other embodiments of the invention.

FIG. 5 shows additional examples of toy figurine characters depicted in their plush costumes and their respective completed looks. In an exemplary implementation, the five different toy figurine characters form a collection of toy figurine sets that a child can choose from or try to collect. In the first toy figurine set 500, the toy figurine is depicted wearing a bunny costume 502. Removing the bunny costume 502 reveals a figurine body 504 that can be further fashioned with accessories 506 for a completed look 508. As part of the unique identity of the toy figurine, figurine body 504 has a first combination 510 of facial features, hair style, and skin complexion. The first toy figurine set 500 also includes a matching pet bunny 512 and brush 514. In the second toy figurine set 600, the toy figurine is depicted wearing a cat costume 602. Removing the cat costume 602 reveals a figurine body 604 that can be further fashioned with accessories 606 for a completed look 608. Figurine body 604 has a second combination 610 of facial features, hair style, and skin complexion that is different from the figurine body 504 of first toy figurine set 500. The second toy figurine set 600 also includes a matching pet kitten 612 and brush 614. In the third toy figurine set 700, the toy figurine is depicted wearing a dog costume 702. Removing the dog costume 702 reveals a figurine body 704 that can be further fashioned with accessories 706 for a completed look 708. Figurine body 704 has a third combination 710 of facial features, hair style, and skin complexion that is different than figurine bodies 504, 604. The third toy figurine set 700 also includes a matching pet puppy 712 and brush 714. In the fourth toy figurine set 800, the toy figurine is depicted wearing a panda costume 802. Removing the panda costume 802 reveals a figurine body 804 that can be further fashioned with accessories 806 for a completed look 808. Figurine body 804 has a fourth combination 810 of facial features, hair style, and skin complexion that that is different than figurine bodies 504, 604, 704. The fourth toy figurine set 800 also includes a matching pet panda 812 and brush 814.

Plush costumes 502, 602, 702, 802 are designed to provide a hint or indication of the toy figurine character concealed underneath. In other words, figurine body 504 is always found underneath the bunny plush costume 502, figurine body 604 is always found underneath the cat plush costume 602, figurine body 704 is always found underneath the dog plush costume 702, and figurine body 804 is always found underneath the panda plush costume 802. This is helpful for a child that is trying to find a specific toy figurine character from a collection of toy figurine sets.

In other embodiments, because the overall dimensions of the toy figurines in toy figurine sets 500, 600, 700, and 800 are similar, if not identical, figurine bodies 504, 604, 704, 804 may be randomly mixed and concealed under plush costumes 502, 602, 702, 802. The figurine bodies and accessories are not associated with a specific corresponding costume and the identity of the toy figurine character as well as its completed look are a mystery until the plush costume is removed and the accompanying accessories are applied. Thus, the discovery of the toy figurine's identity and its completed look becomes a fun unveiling event for the child.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. For instance, although the depicted embodiments illustrate the figurine body as a human figurine, the figurine presented herein need not be a human. For example, in other embodiments, the figurine might be an animal, mythical character, alien, or other living or non-living object.

Moreover, it is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" may be used herein to describe an example or illustration. Any embodiment described herein as exemplary is not to be construed as a preferred or advantageous embodiment, but rather as one example or illustration of a possible embodiment of the invention. Finally, various features from one of the embodiments may be incorporated into another of the embodiments.

The invention claimed is:

1. A toy figurine comprising:

a figurine body with an identity selected from a set of identities;

a removable plush costume covering the figurine body and obscuring the identity of the figurine body when packaged for sale, the plush costume including separately removable portions, comprising:

a first reversible portion having a first surface and a second surface opposite to the first surface;

a second reversible portion having a third surface and a fourth surface opposite the third surface;

wherein the first surface and the third surface are oriented outwardly when the first reversible portion and the second reversible portion are worn in a first configuration;

the second surface and the fourth surface are oriented outwardly when the first reversible portion and the second reversible portion are worn in a second configuration; and the first surface and the fourth surface are oriented outwardly when the first reversible portion and the second reversible portion are worn in a third configuration, wherein the first configuration corresponds to a first completed look, the second configuration corresponds to a second completed look, and the third configuration corresponds to a third completed look; and wherein removing one or more of the separately removable portions reveals the identity of the figurine body.

2. The toy figurine of claim 1, wherein the identity of the figurine body is defined by at least one of a skin complexion, a facial feature, a hair style, or a body shape.

3. The toy figurine of claim 1, wherein the separately removable portions of the plush costume comprises at least two of a head portion, an upper torso portion, a lower torso portion, a hand portion, or a feet portion.

4. The toy figurine of claim 3, wherein the plush costume is an animal costume and the head portion resembles a head of an animal.

5. The toy figurine of claim 3, wherein:

the figurine body includes a torso, a head mounted to the torso, hair attached to the head, arms movably coupled to the torso, and legs movably coupled to the torso; and the head portion of the plush costume is sized to cover the head and contain all of the hair attached to the head of the figurine body.

6. The toy figurine of claim 1 further including one or more accessories configured to be worn or attached to the figurine body, the one or more accessories individually packaged in obscure packaging so that a completed look of the toy figurine is revealed when the one or more accessories are removed from the obscure packaging and worn or attached to the figurine body.

7. The toy figurine of claim 6, wherein the one or more accessories is at last one of a hair accessory, a clothing article, or shoes.

8. The toy figurine of claim 1, wherein the figurine body comprises one or more thermochromic features.

9. The toy figurine of claim 8, wherein the one or more thermochromic features comprise a thermochromic facial feature or a thermochromic hair.

10. A toy figurine set comprising:

a toy figurine;

a plush covering that conceals the toy figurine and is removable from the toy figurine to reveal an identifying characteristic of the toy figurine, the plush covering comprising a separately removable upper torso portion and another portion, each of the torso portion and said another portion having a first surface and a second surface opposite the first surface; and one or more accessories configured to be worn or attached to the toy figurine, the one or more accessories are packaged in obscure packaging that conceals the one or more accessories so that at least two completed looks of the toy figurine are revealed when the one or more accessories are removed from the obscure packaging and worn or attached to the toy figurine;

wherein the at least two completed looks comprise:

a first look comprising the one or more accessories and the upper torso portion with the first surface of the upper torso portion oriented outwardly;

a second look comprising the one or more accessories and the upper torso portion with the second surface of the upper torso oriented outwardly; and a third look comprising said another portion of the plush covering and the upper torso portion with the first surface or the second surface of the upper torso oriented outwardly.

11. The toy figurine set of claim 10, wherein the identifying characteristic of the toy figurine is at least one of a skin complexion, a facial feature, a hair style, or a body shape.

12. The toy figurine set of claim 10, wherein said another portion of the plush covering includes at least one of a head portion, a lower torso portion, a hand portion, or a feet portion that is separately removable from the toy figurine.

13. The toy figurine set of claim 10, wherein the plush covering is an animal costume that includes a head portion resembling a head of an animal.

14. The toy figurine set of claim 10, wherein the toy figurine comprises one or more thermochromic features.

15. The toy figurine set of claim 14, wherein the one or more thermochromic features comprise a thermochromic facial feature or a thermochromic hair.

16. A toy comprising:

an underlying body;

a plush covering that conceals the underlying body and is removable from the underlying body to reveal an identity of the underlying body, the plush covering comprising a separately removable upper torso portion and another portion, each of the torso portion and said another portion having a first surface and a second surface opposite the first surface; and one or more accessories that are configured to be attached to the underlying body, the one or more accessories are individually packaged in obscure packaging so that at least one completed look of a plurality of completed looks of the toy is revealed when the one or more accessories are removed from the obscure packaging and attached to the underlying body;

wherein the plurality of completed looks of the toy comprises:

a first look comprising the one or more accessories and the upper torso portion with the first surface of the upper torso portion oriented outwardly;

a second look comprising the one or more accessories and the upper torso portion with the second surface of the upper torso portion oriented outwardly; and a third look comprising said another portion of the plush covering and the upper torso portion with the first surface or the second surface of the upper torso oriented outwardly.

17. The toy of claim 16, wherein at least a portion of the plush covering is separately removable to reveal the identity of the underlying body.

18. The toy of claim 16, wherein the underlying body comprises one or more thermochromic features.

19. The toy of claim 16, wherein the obscure packaging is stored within the plush covering.

* * * * *